US008225865B2

(12) United States Patent
Robert et al.

(10) Patent No.: US 8,225,865 B2
(45) Date of Patent: Jul. 24, 2012

(54) SYSTEM AND METHOD FOR ALIGNING A COMPONENT OF A BOREHOLE ASSEMBLY

(75) Inventors: Ralph J. Robert, Lafayette, LA (US); Armanto Kimiadi, Lafayette, LA (US); Louis F. Lafleur, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 438 days.

(21) Appl. No.: 12/550,765

(22) Filed: Aug. 31, 2009

(65) Prior Publication Data

US 2010/0116509 A1 May 13, 2010

Related U.S. Application Data

(60) Provisional application No. 61/113,420, filed on Nov. 11, 2008.

(51) Int. Cl.
*E21B 17/046* (2006.01)
*E21B 19/16* (2006.01)

(52) U.S. Cl. ..... 166/242.6; 166/380

(58) Field of Classification Search ..... 166/242.6, 166/255.2, 378, 380
See application file for complete search history.

(56) References Cited

U.S. PATENT DOCUMENTS

| | | | | |
|---|---|---|---|---|
| 5,269,572 | A * | 12/1993 | Mefferd | 285/330 |
| 6,666,274 | B2 * | 12/2003 | Hughes | 166/385 |
| 7,213,655 | B2 * | 5/2007 | Parrott | 166/380 |
| 7,497,254 | B2 * | 3/2009 | Hall et al. | 166/65.1 |
| 7,669,671 | B2 * | 3/2010 | Hall et al. | 175/74 |
| 2007/0063513 | A1 * | 3/2007 | Boyd | 285/355 |
| 2011/0180273 | A1 * | 7/2011 | Hughes et al. | 166/380 |

* cited by examiner

*Primary Examiner* — Giovanna Wright
(74) *Attorney, Agent, or Firm* — Cantor Colburn LLP

(57) ABSTRACT

An apparatus for aligning a component includes: a downhole sub including a plurality of first axially extending tapered members, the plurality of first axially extending tapered members configured to engage a plurality of second axially extending tapered members of a downhole carrier in an interlocking engagement and prevent rotation of the downhole carrier relative to the downhole sub.

20 Claims, 12 Drawing Sheets

Rotating 13 CR Vam Top Pin X Pin

A Filter Assembly
B CL Splice for IWS
C CL Splice for IWS
D CL Splice for IWS
E TEC Splice
F TEC Splice
G CI Line Splice Slot Designation for the Hanger Filter Splice Mandrel A SCSSV Filter Assembly
B Control Line Splice for IWS
C Control Line Splice for IWS
D Control Line Splice for IWS
E TEC Splice for DHPT
F TEC Splice for DHPT
G Line Splice for Chemical Injection

SYSTEM AND METHOD FOR ALIGNING A COMPONENT OF A BOREHOLE ASSEMBLY

CROSS REFERENCE TO RELATED APPLICATION

This application claims priority to U.S. provisional application, 61/113,420, filed Nov. 11, 2008, under 35 U.S.C. §119(e), and which is incorporated herein by reference in its entirety.

BACKGROUND

Splice subs are utilized in hydrocarbon production and formation evaluation systems. Splice subs allow for connection of power, hydraulic or other lines between surface and downhole components.

In the complex operation of drilling and completing subterranean borehole systems such as oil and gas wells, geothermal wells, Carbon Dioxide sequestration systems, etc. conditions down the bore hole such as temperature and pressure in the reservoir might desirably be monitored, and it is also desirable that devices downhole be actuated remotely. Commonly such desirable attributes are achieved by running monitoring and or control lines, which may be fiber optic, electrical, hydraulic, etc. Because completion or drilling tubing is generally made up in sections, splices are typically required in any electrical, optical, hydraulic or other lines attached to the completion or drilling tubing. Such lines may be included in tubing that is attached outside a tubing string or other component. Splices are difficult to achieve due to alignment considerations, etc.

SUMMARY

Disclosed herein is an apparatus for aligning a component. The apparatus includes: a downhole sub including a plurality of first axially extending tapered members, the plurality of first axially extending tapered members configured to engage a plurality of second axially extending tapered members of a downhole carrier in an interlocking engagement and prevent rotation of the downhole carrier relative to the downhole sub.

Also disclosed herein is a method of aligning a component. The method includes: connecting a downhole sub to an elongated member configured to be lowered into a borehole, the downhole sub including a plurality of first axially extending tapered members; and moving a downhole carrier axially to engage the downhole sub, the downhole carrier including a plurality of second axially extending tapered members configured to engage the plurality of first axially extending tapered members in an interlocking engagement.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
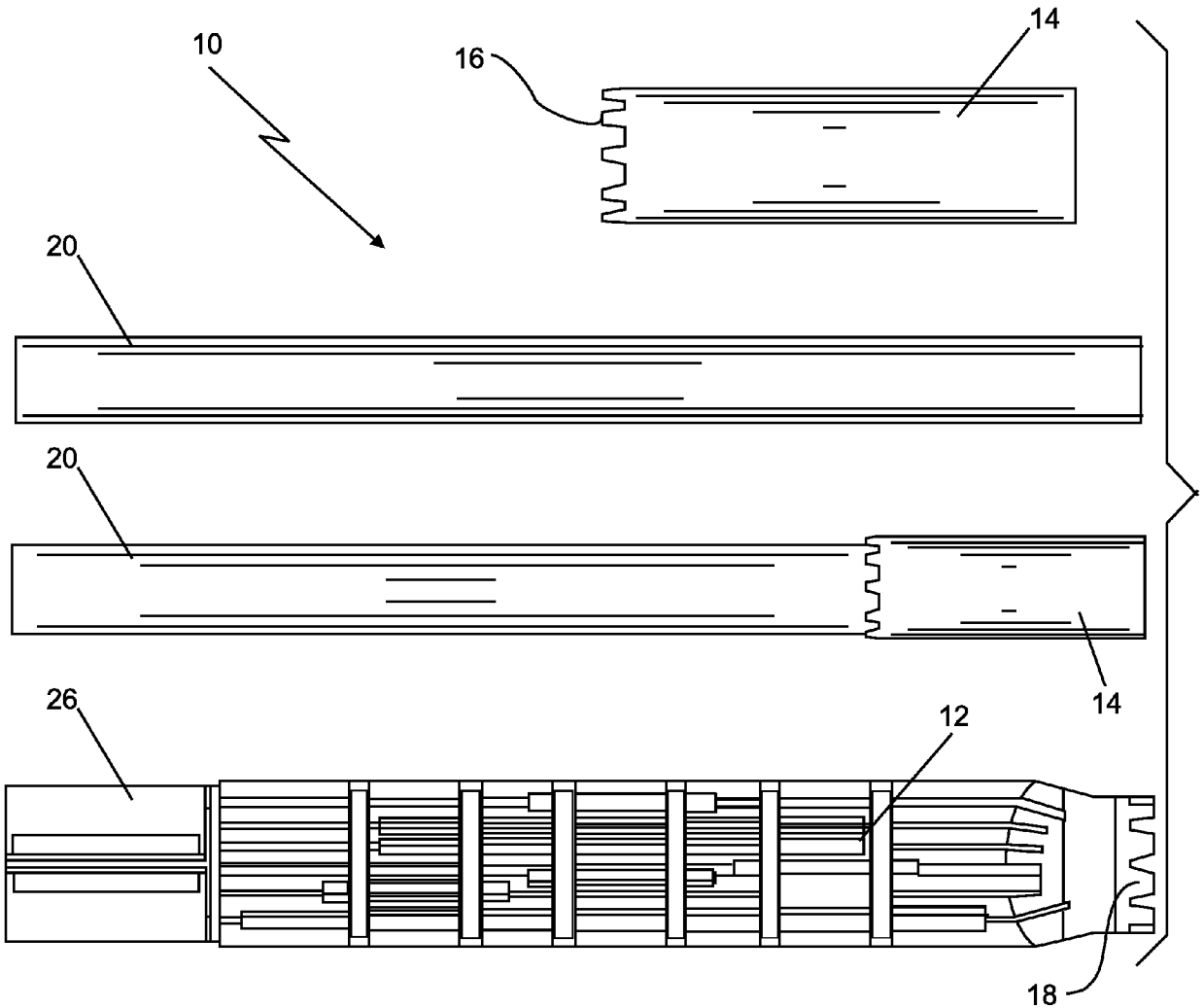
FIG. 1 depicts an exemplary embodiment of a portion of a well logging and/or drilling system including a securing mechanism.
Figure 2:
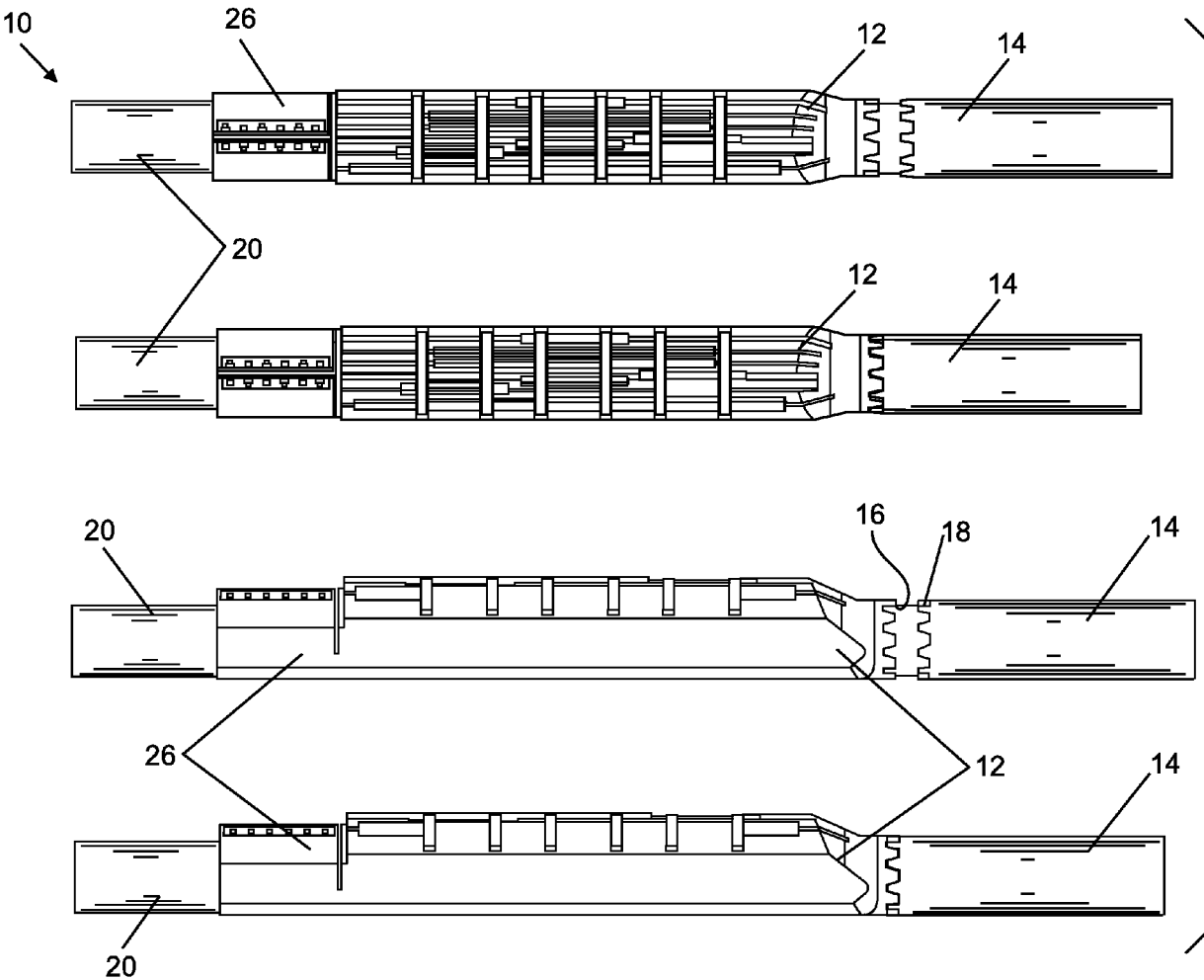
FIG. 2 depicts top and side views of an alignment coupling and a downhole carrier of the system of FIG. 1 in a locked and unlocked position.
Figure 3:
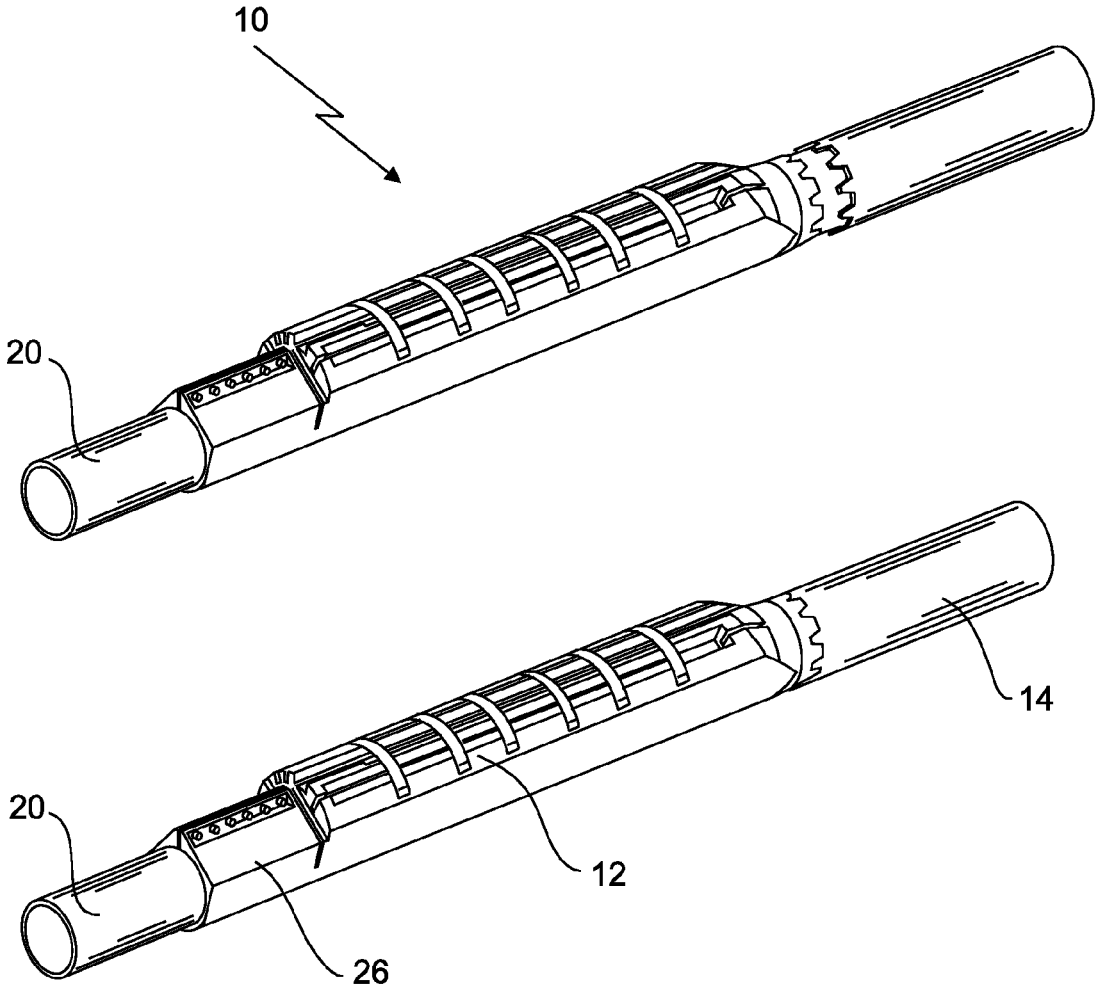
FIG. 3 depicts perspective views of the alignment coupling and the downhole carrier of the system of FIG. 1 in a locked and unlocked position.
Figure 4:
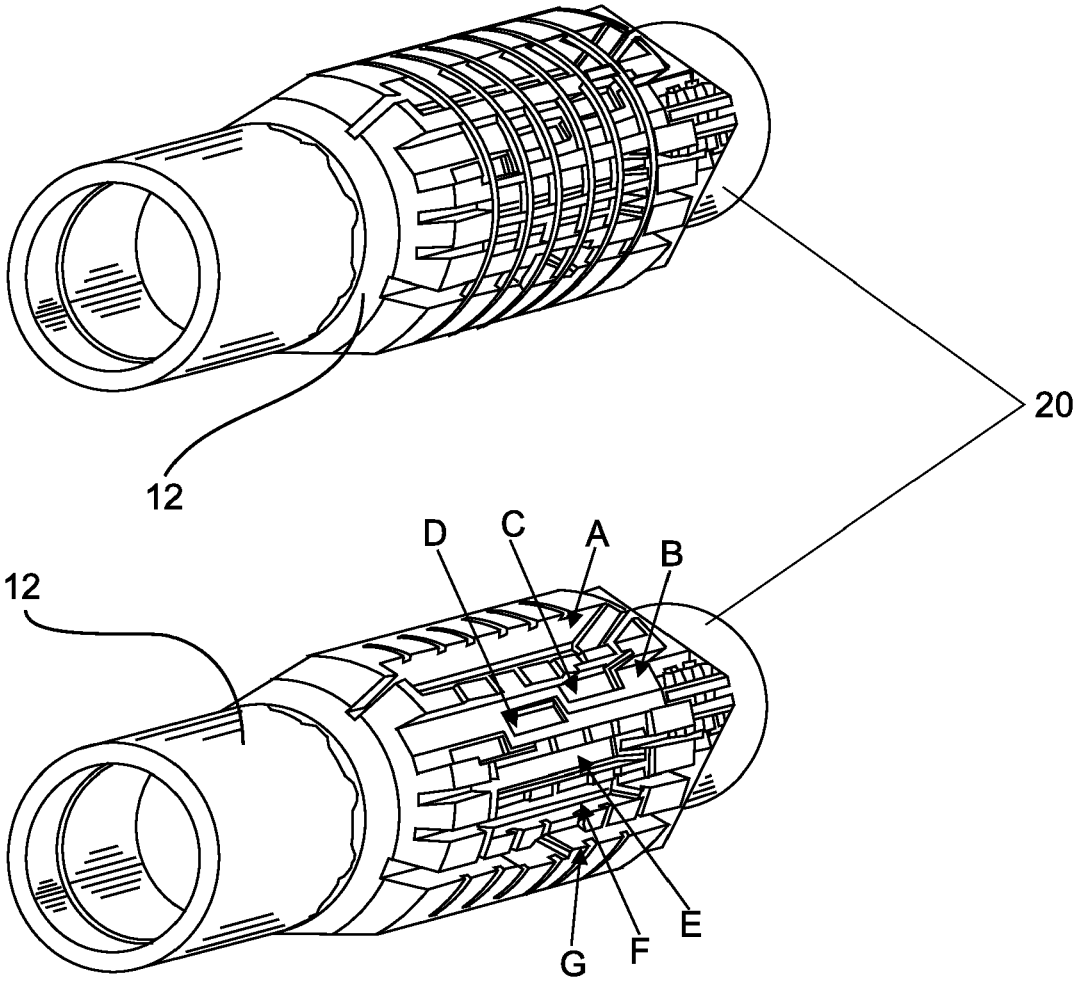
FIG. 4 depicts a front perspective view of the downhole carrier of the system of FIG. 1.
Figure 5:
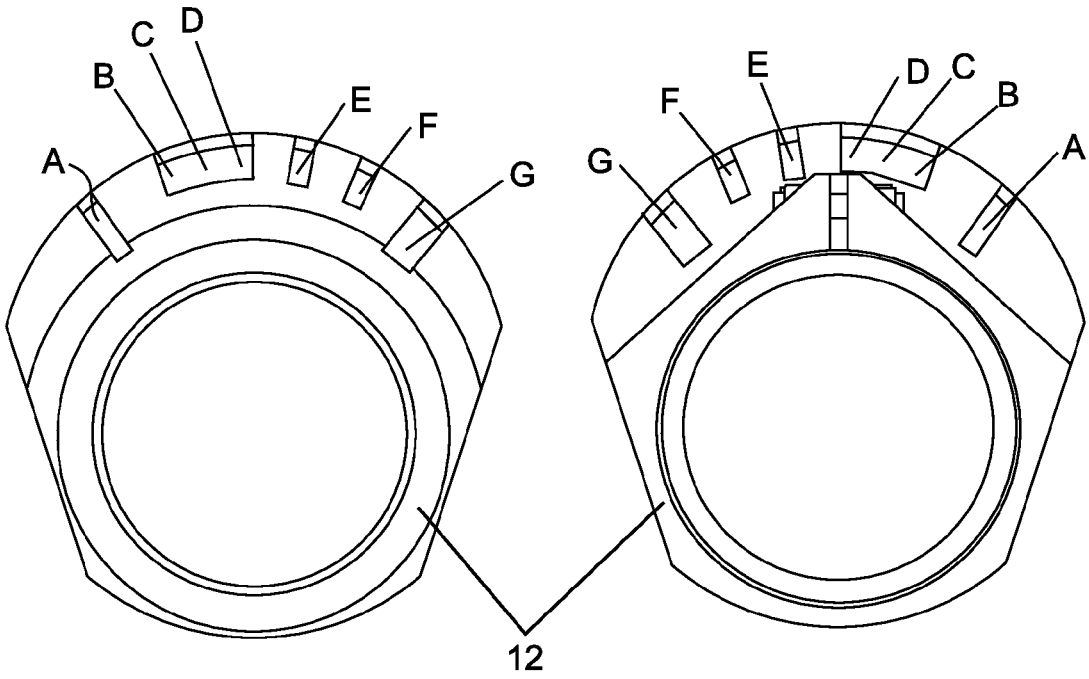
FIG. 5 depicts an uphole and downhole view of the downhole carrier of the system of FIG. 1.

Referring to FIGS. 1-5, an exemplary embodiment of a portion of a well logging and/or drilling system 10 includes a drillstring, production string or other borehole string. In one embodiment, the string is a production string.

The system 10 includes a downhole carrier 12 that is configured to house and/or support components of the system 10 in a downhole environment. In one example, the downhole carrier 12 is a splice sub or splice carrier 12 that includes any of various electrical, optical, hydraulic or other lines. A downhole sub 14, referred to herein as an alignment coupling 14, is configured to engage the downhole carrier 12 at a first end so that connections within the alignment coupling 14 can be properly aligned with connections in the downhole carrier 12. In one embodiment, the alignment coupling 14 is further connected to a hanger (not shown). In one embodiment, the downhole carrier 12 holds several splice subs and filters, or other devices such as gauges or injection valves required for drilling, completing and/or evaluating oil and gas boreholes. In one embodiment, the alignment coupling 14 is configured as a downhole sub that can be lowered into the borehole. The downhole carrier 12 is not limited to the embodiments described herein, as the downhole carrier 12 may include drilling components, sensors or other logging components, hydrocarbon production components and/or any other components desired to be disposed downhole.

Each of the downhole carrier 12 and the alignment coupling 14 include one or more protrusions or members 16, 18 extending in an axial direction and configured to engage each other to prevent rotational movement relative to each other. In one embodiment, each of the downhole carrier 12 and the alignment coupling 14 include a plurality of axially extending members 16, 18. The members 16 and the members 18 are configured to form an interlocking engagement with each other. "Interlocking engagements" may include various configurations such that the members 16 and the members 18 interlace or otherwise fit together so that the rotational or other movement of the carrier 12 and the alignment coupling 14 are coordinated or synchronized. The members 16, 18 may have any shape suitable to form the interlocking engagement, and are not limited to the shapes and configurations described herein. As used herein, "axial" refers to a direction substantially parallel to the major axis of the downhole carrier 12 and/or the alignment coupling 14.

Prior to engaging the members 16, 18, the downhole carrier 12 is rotatable to allow the connections therein to be properly aligned. In one embodiment, the alignment coupling 14 is fixed to production tubing or other elongated and/or orientation member, such as a pup joint 20. As the members 16, 18 come into contact, they engage to prevent rotational movement of the downhole carrier 12 and the alignment coupling 14 relative to one another.

In one embodiment, the downhole carrier 12 and the alignment coupling 14 are configured to be disposed about the pup joint 20, production string or other borehole string, or other body configured to be disposed within the borehole and forming all or part of a borehole assembly. The alignment coupling 14 is secured to the pup joint 20 by any suitable mechanism, such as a threaded connection, a screw or bolt connection and a weld. In one embodiment, the pup joint 20 is a pin-by-pin pup joint.

In one embodiment, the alignment coupling 14 is configured to be secured to the pup joint 20 at a selected location relative to the downhole carrier 12. In this way, the downhole carrier 12 can be freely rotated and moved toward or away from the alignment coupling 14. The downhole carrier 12 may be restricted in axial movement by its own weight, the weight of another component and/or by a suitable securing mechanism. For example, the alignment coupling 14 is configured to be secured to the pup joint 20 at a downhole location relative to the downhole carrier 12. In this example, the downhole carrier 12 can be lowered onto the alignment coupling 14 and can also be lifted off of the alignment coupling 14 to be rotated as desired to properly align the downhole carrier 12 connections with the connections in the alignment coupling 14. As the downhole carrier 12 is brought into engagement with the alignment coupling 14, the members 16, 18 engage and limit or prevent rotation of the downhole carrier 12 and the alignment coupling 14 relative to one another.

In one embodiment, the axially extending members 16, 18 form a slip fit configuration, i.e., a sliding fit between the axially extending members 16, 18 that allows the members 16, 18 to fit together with little or no pressure applied. For example, each of the plurality of axially extending members 16, 18 is tapered in the axial direction. In one embodiment, the members 16 and/or the members 18 include a deformable portion configured to form an interference fit when engaged with each other. For example, as shown in FIGS. 6 and 7, the members 16 and/or the members 18 include a locking mechanism configured to lock the members 16, 18 into each other when the downhole carrier 12 and the alignment coupling 14 are engaged.

Figure 6:
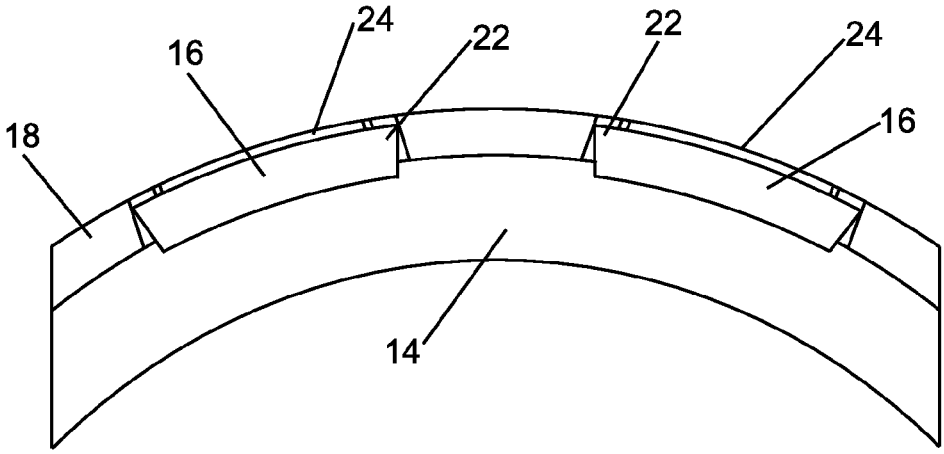
FIG. 6 depicts a front view of a portion of an embodiment of the alignment coupling and the downhole carrier of the system of FIG. 1 prior to engagement.
Figure 7:
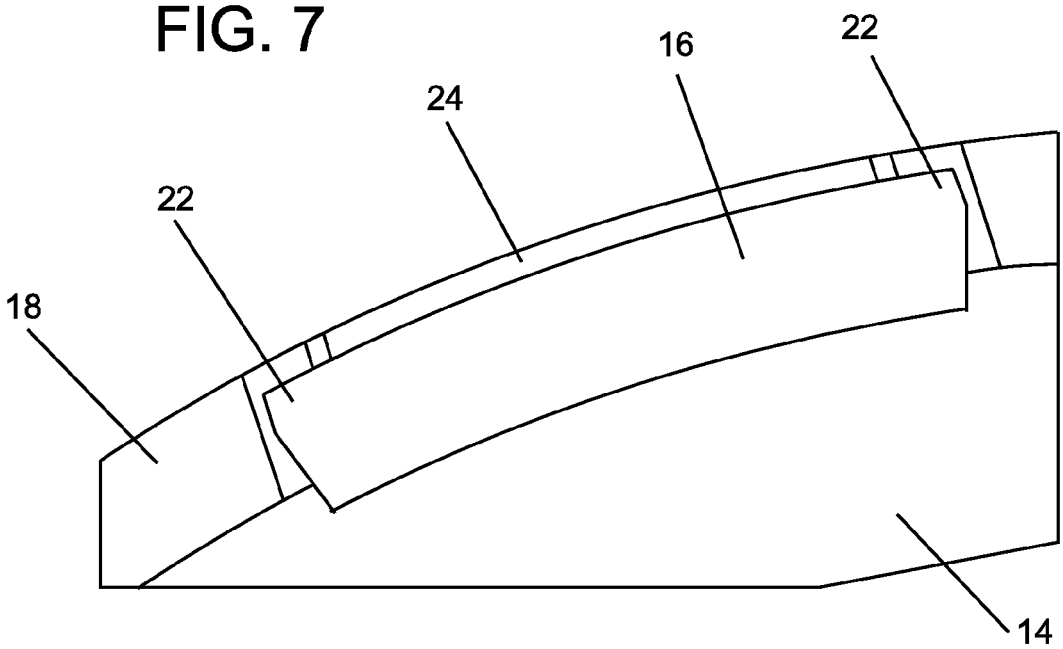
FIG. 7 depicts a close-up view of the embodiment of FIG. 6 in a locked position.

Referring to FIGS. 6 and 7, the members 16 and/or the members 18 are configured so that the members 16, 18 form an interference fit. For example, the members 16 are shaped so that they are at least slightly larger than or interfere with the space formed between the corresponding members 18, so that the members 16, 18 are locked together when engaged. In one embodiment, the members 16 and/or the members 18 include a portion 22 that is configured to deform and press against corresponding members 16, 18 when engaged. In one embodiment, each of the members 16 are chamfered so that a thin or pointed edge 22 is formed as the deformable portion 22. The corresponding members 18 include corresponding slots 24 that receive the members 16 and cause the deformable edge to deform. Upon engagement, the deformable edge 22 is configured to deform so that an interference fit is formed between the members 16 and the members 18 to prevent axial movement of the downhole carrier 12 and the alignment coupling 14 relative to one another.

Figure 8:
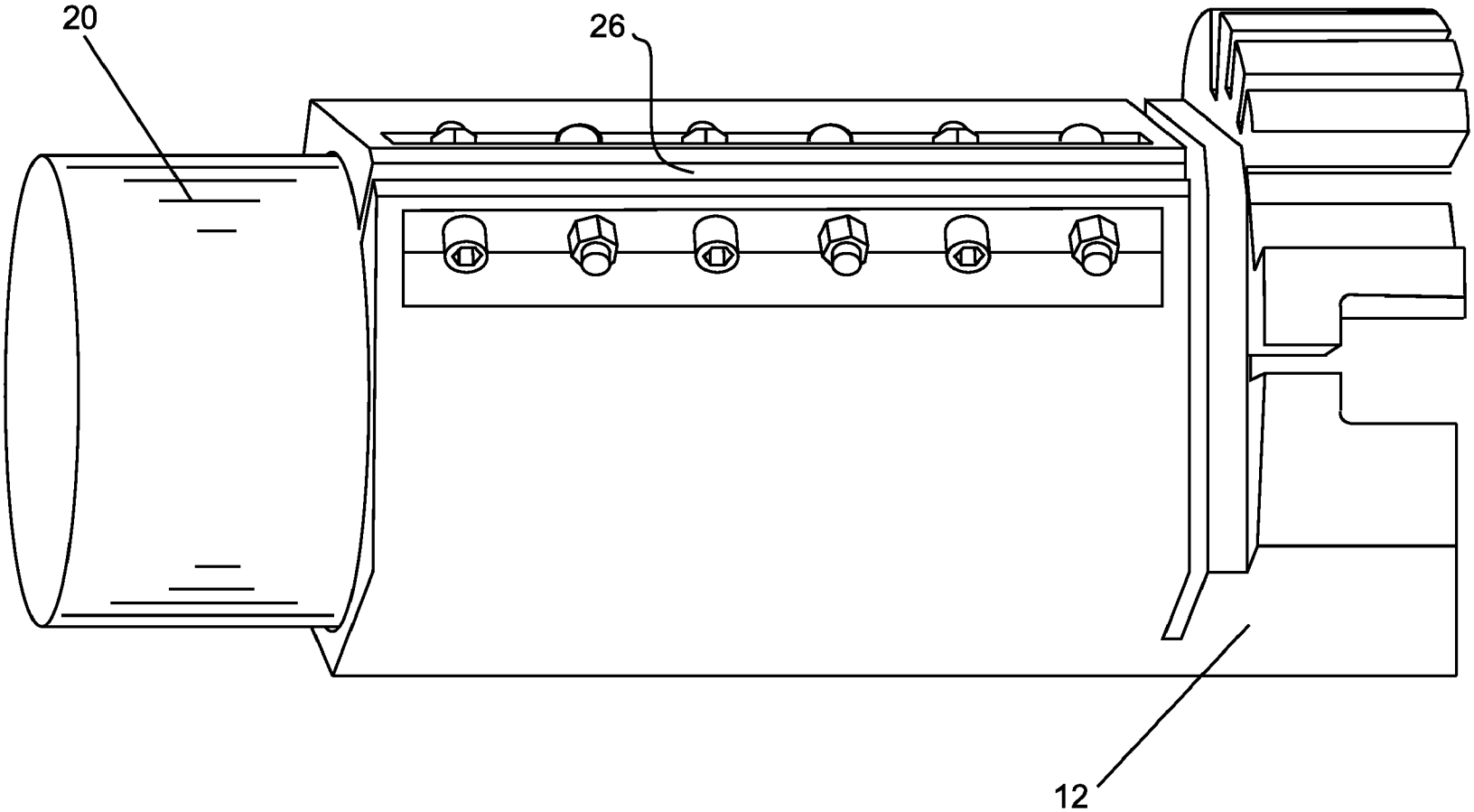
FIG. 8 depicts a side perspective view of a clamping member of the system of FIG. 1.
Figure 9:
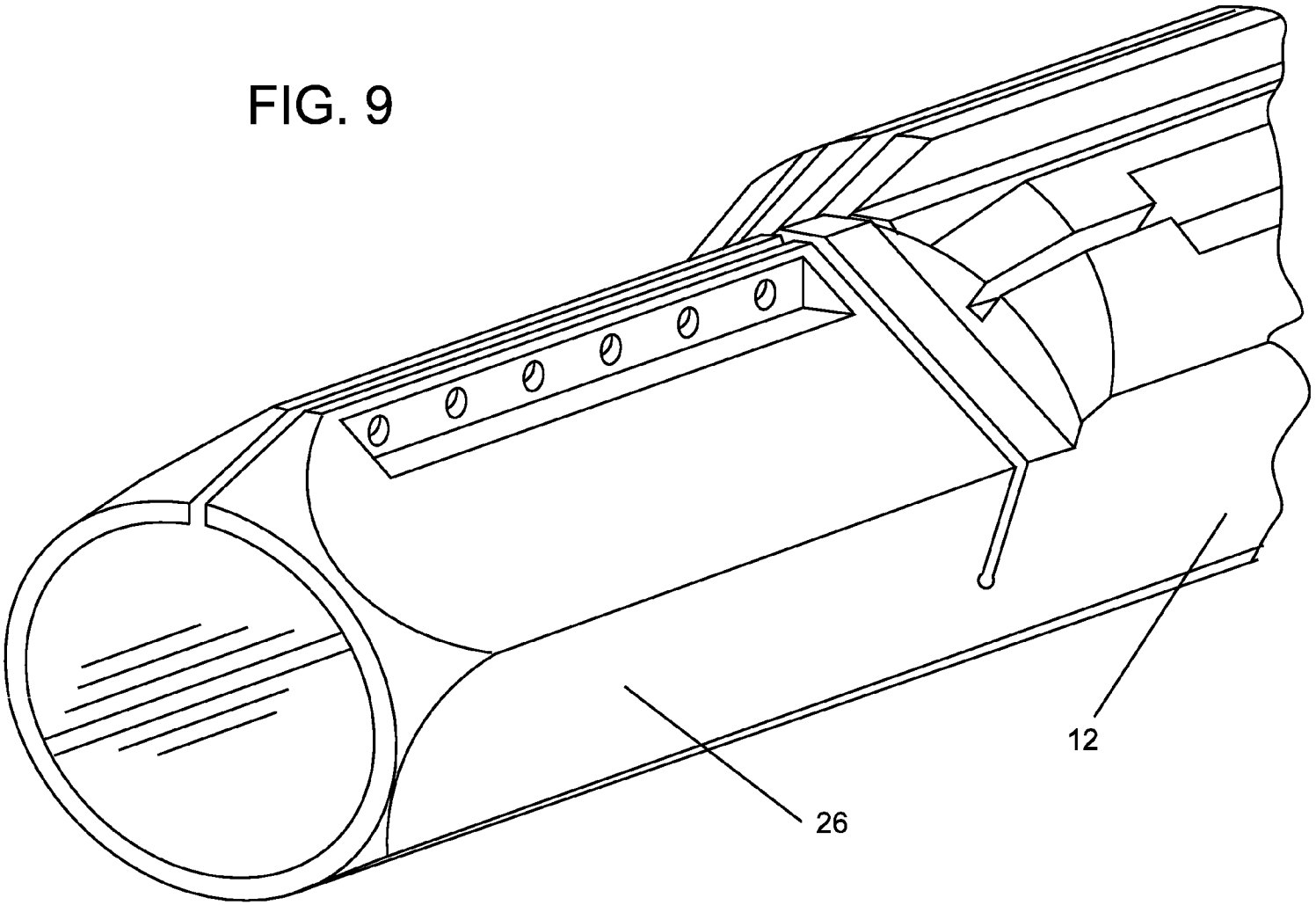
FIG. 9 depicts a downhole perspective view of a clamping member of the system of FIG. 1.

Referring to FIGS. 8 and 9, in one embodiment, a securing mechanism 26 is secured at a second end of the downhole carrier 12 to hold the downhole carrier 12 in engagement with the alignment coupling 14 and prevent axial movement of the downhole carrier 12. The securing mechanism 26 is configured to be closed to engage the pup joint 20, the production string or other body to secure the downhole carrier 12 in place on the pup joint 20. In one embodiment, the securing mechanism 26 is configured as a sleeve or collar that can be disposed about the pup joint 20 and locked into place, such as by one or more screws or bolts. The securing mechanism 26 may be of any configuration, such as a jaw or clamp, suitable to be secured in place on or about the pup joint 20. Although the figures herein illustrate the securing mechanism 26 as being located at an end opposite the members 16, 18, the securing mechanism 26 or an additional securing mechanism could be used at any location as desired or dictated by application. For example, a securing mechanism located at or near the members 16, 18 could be included in addition to or in place of the securing mechanism 26.

Figure 10:
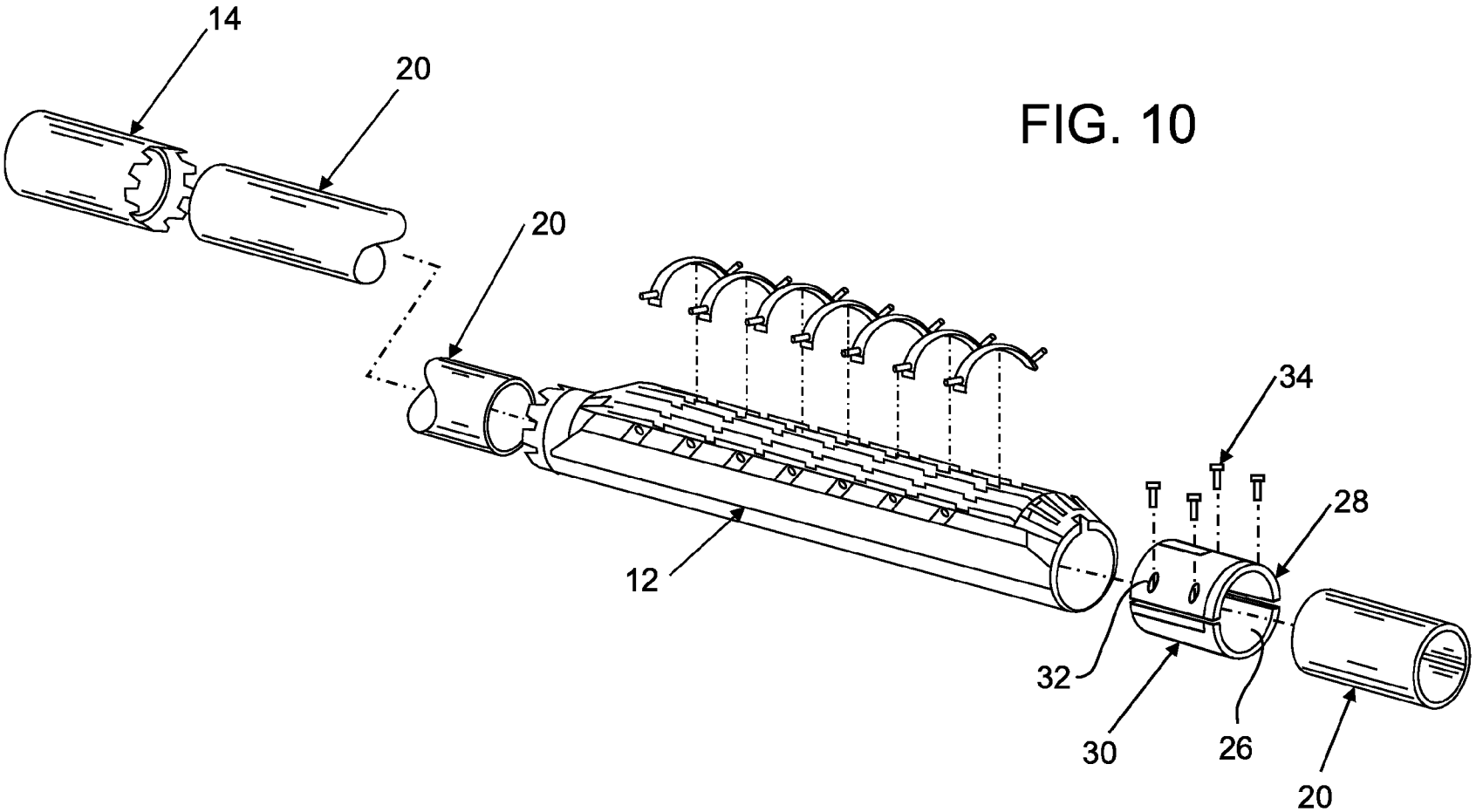
FIG. 10 depicts an exemplary embodiment of a portion of a well logging and/or drilling system including a securing mechanism.

Referring to FIG. 10, in one embodiment, the securing mechanism 26 is a separate component that is engageable or connectable with the downhole carrier 12. A separate securing mechanism 26 may provide the benefit of the ability to separately machine or otherwise manufacture the downhole carrier 12 and the securing mechanism 26. The separate securing mechanism 26 is configured to be independently moved and/or rotated into place in engagement with the downhole carrier 12 and/or the pup joint 20. For example, the securing mechanism 26 is configured with a threaded coupling that is timed to properly axially align with the downhole carrier 12 when the securing mechanism 26 is fully engaged with the downhole carrier 12.

In one embodiment, as shown in FIG. 10, the securing mechanism 26 includes an upper section 28 and a lower section 30 that are configured to be brought together in engagement with the pup joint 20 or other component to secure the securing mechanism 26. For example, the upper section 28 and the lower section 30 include openings 32 configured to accept fasteners 34, such as screws or nuts and bolts. The upper and lower sections 30 can be brought together to act as a clamp around the pup joint 20.

Figure 11:
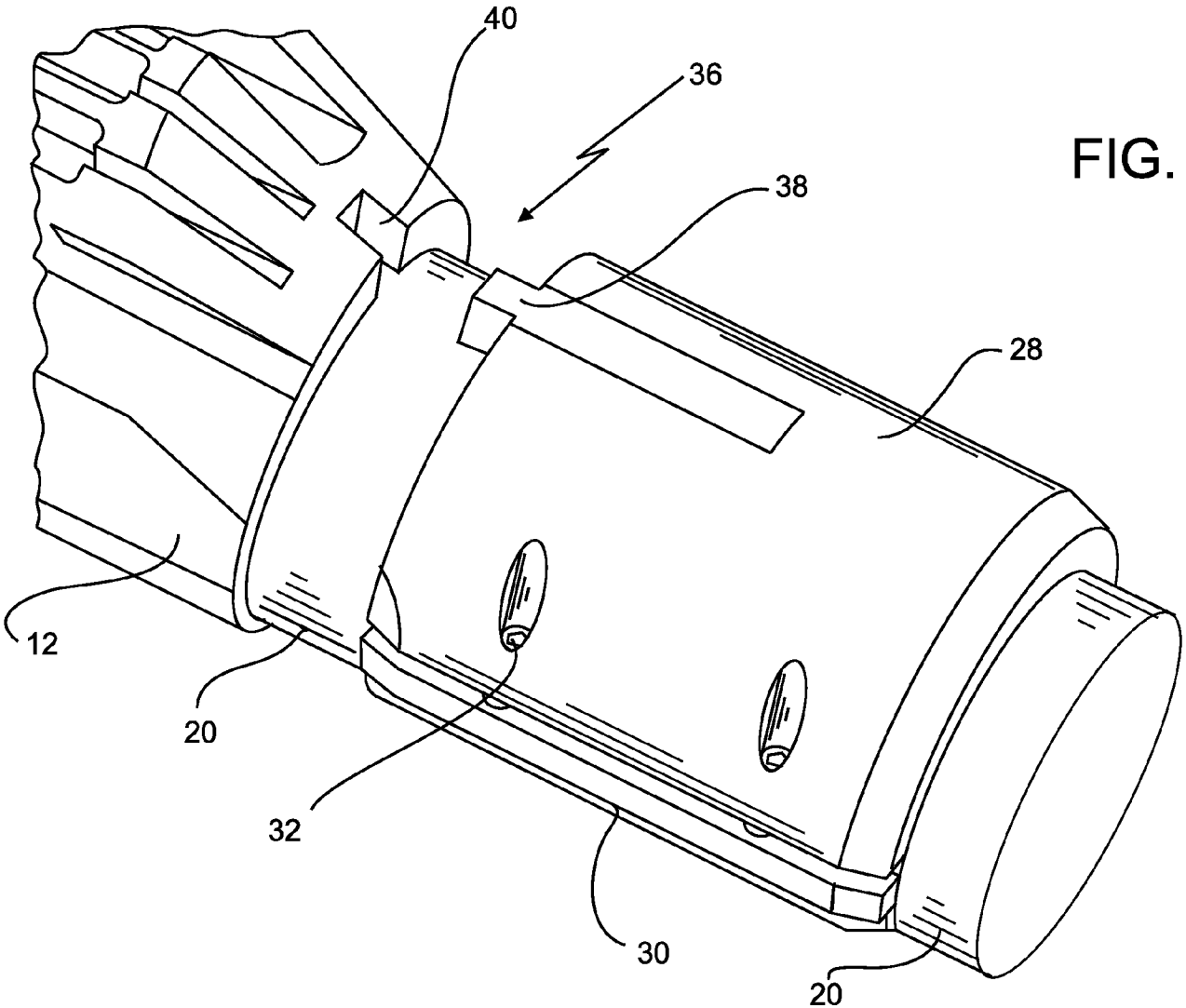
FIG. 11 depicts a perspective view of a portion of the system of FIG. 10, including a securing mechanism in an unlocked position.
Figure 12:
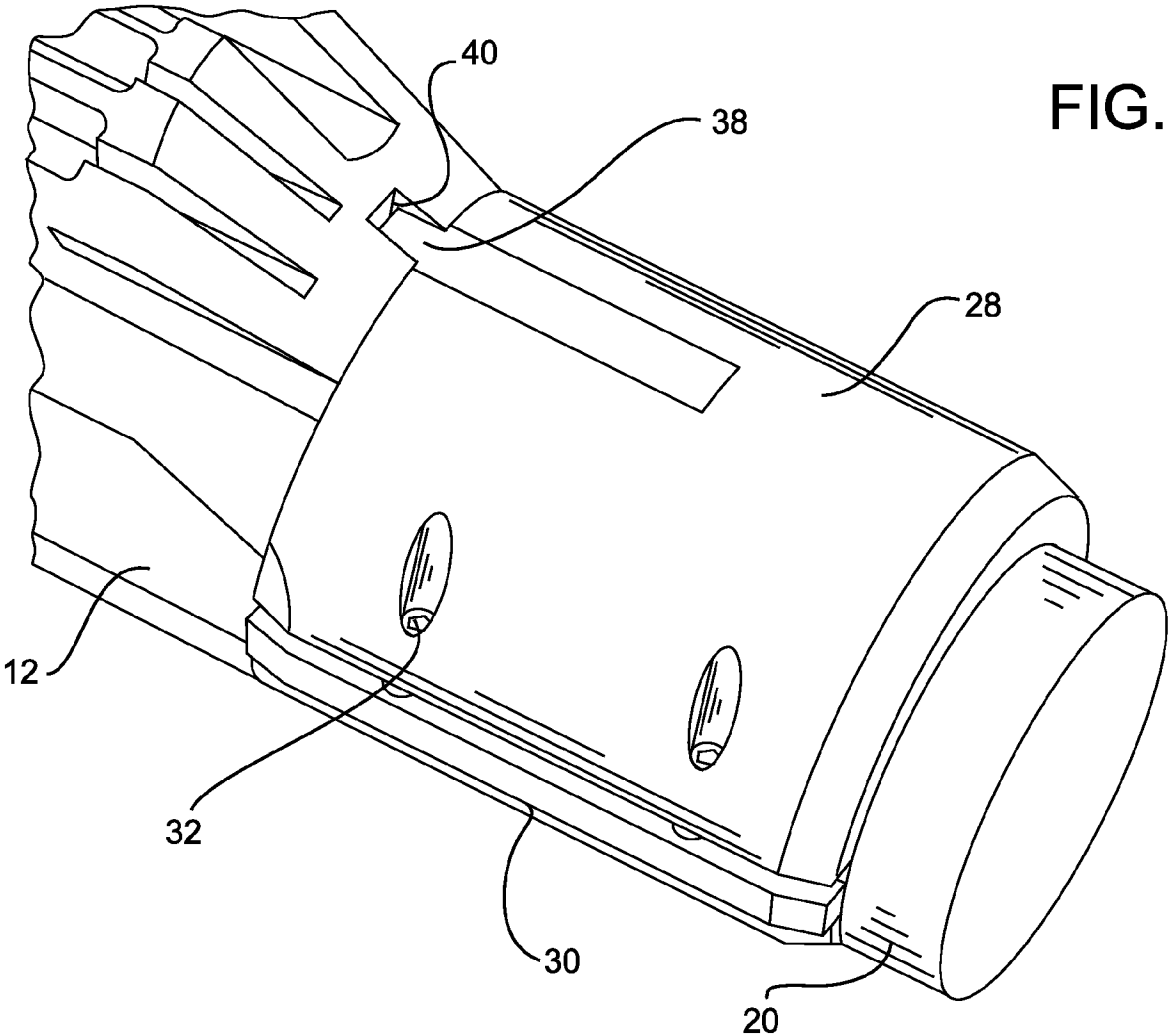
FIG. 12 depicts a perspective view of a portion of the system of FIG. 10, including a securing mechanism in a locked position.
Figure 13:
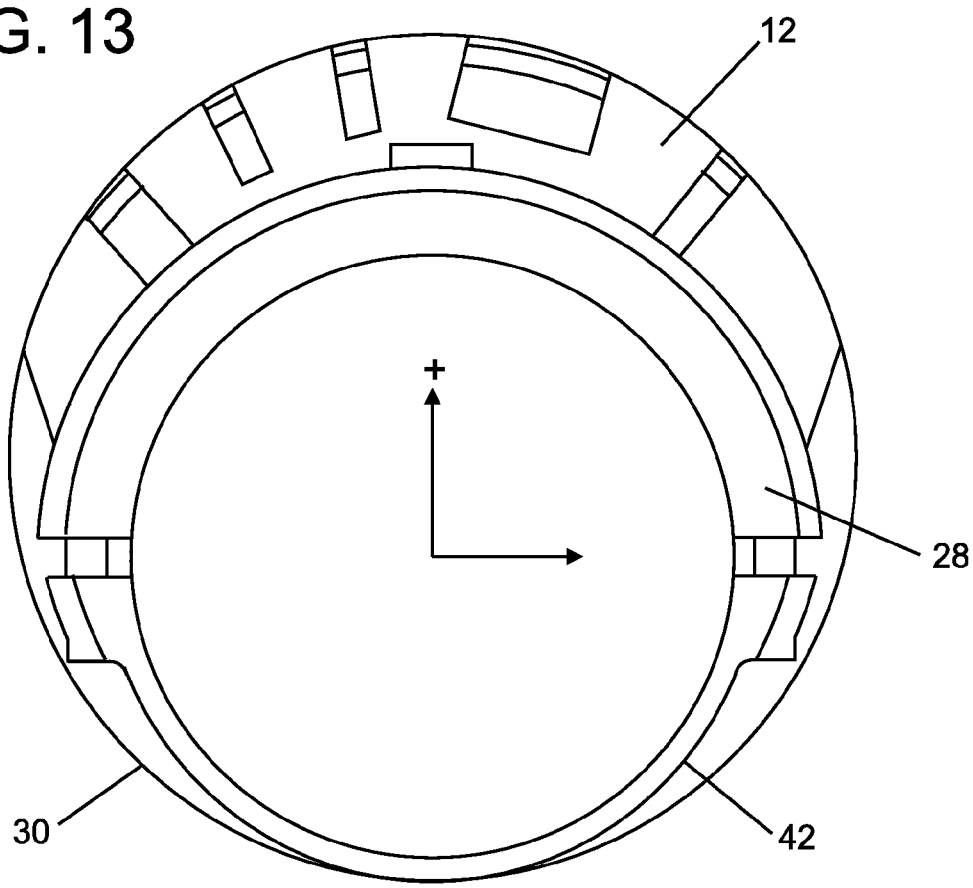
FIG. 13 depicts a front view of the portion of the system of FIG. 10 in a locked position.

Referring to FIGS. 11-13, in one embodiment, the securing mechanism 26 and/or the downhole carrier 12 includes an alignment mechanism 36 configured to maintain the securing mechanism 26 and the downhole carrier 12 in alignment with one another. For example, the securing mechanism 26 includes an alignment member 38, such as a tooth or other generally axial protrusion, and the downhole carrier 12 includes an alignment recess 40, such as a slot. The alignment member 38 is configured to be at least partially disposed in the alignment recess 40 when the downhole carrier 12. The alignment member 38 may have any desired shape, such as a rectangular shape, a cylindrical shape, a tapered shape and a conical shape.

The configuration of the alignment mechanism 36 is not limited to the descriptions herein, as the alignment mechanism 36 may take any suitable form sufficient to limit or prevent rotational movement of the downhole carrier 12 and the securing mechanism 26 relative to one another. Examples of alignment mechanism configurations include fasteners such as bolts or screws, timed thread configurations, and a plurality of complimentary teeth or other members.

Referring to FIG. 13, in one embodiment, the alignment mechanism 36 acts to maintain a selected outside diameter 42 (i.e., "running outside diameter") as defined by the downhole carrier 12 and the securing mechanism 26. In one example, the alignment mechanism 36 prevents the securing mechanism 26 and the downhole carrier 12 from rotating relative to one another, which could increase or otherwise affect the running outside diameter 42.

In one embodiment, one or more portions of the interior diameter of the downhole carrier 12 are undercut to reduce the interval of length of the tight slip fit around the outside diameter of the pup joint 20. This configuration may provide additional tolerance of defects or damage to the outside diameter of the pup joint 20 as the downhole carrier 12 is lowered, rotated or otherwise moved into position about the pup joint 20. In another embodiment, in addition to or in place of making one or more undercuts, selected portions of the downhole carrier 12 are machined away or otherwise removed to reduce the length of the interior diameter that is in close proximity to the pup joint 20. For example, windows could be cut out of the carrier interior while leaving sufficient portions of the interior to support the various splices, filters or other devices therein. In addition to reducing the length of interior diameter, this configuration would also reduce the weight of the downhole carrier 12, making it easier for personnel to lift and rotate the downhole carrier 12 into position.

As described herein, "drillstring", "string" or "downhole carrier" refers to any structure or carrier suitable for lowering a tool or other component through a borehole or connecting a drill bit to the surface, and is not limited to the structure and configuration described herein. For example, the string is configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, BHA's and drill strings.

Figure 14:
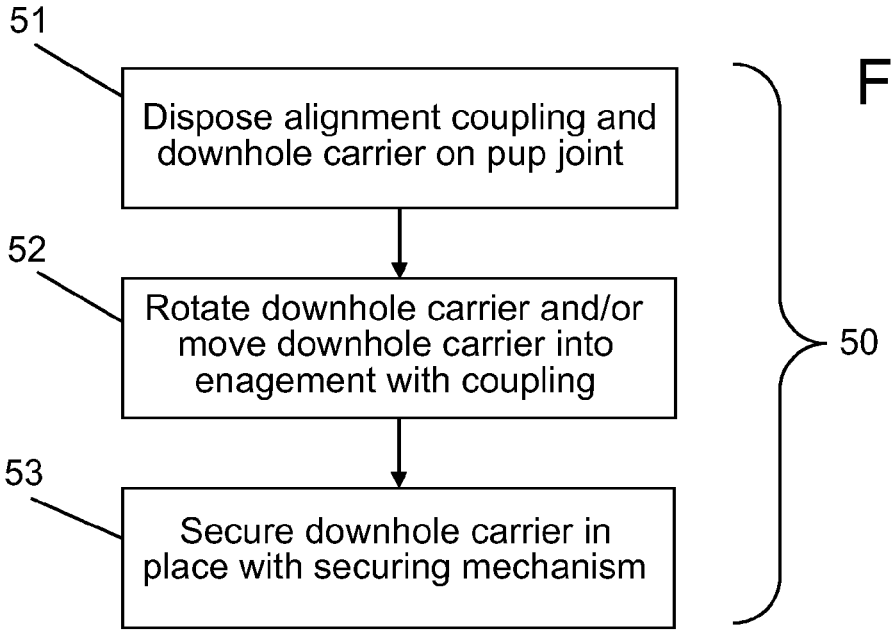
FIG. 14 is a flow diagram depicting a method of aligning a downhole component and/or securing a connection between a surface device and a downhole member.

FIG. 14 illustrates a method 50 of aligning a component such as a downhole component and/or securing a connection between components such as the downhole carrier 12 and the alignment coupling 14. The method 50 includes one or more stages 51-53. In one embodiment, the method 50 includes the execution of all of stages 51-53 in the order described. However, certain stages may be omitted, stages may be added, or the order of the stages changed.

In the first step 51, the alignment coupling 14 and the downhole carrier 12 are slid or otherwise disposed onto the pup joint 20. In one embodiment, the alignment coupling 14 is fixed in place relative to the pup joint 20 and/or the hanger prior to sliding the downhole carrier 12 onto the pup joint 20.

In the second step 52, the downhole carrier 12 is rotated to orient the downhole carrier 12 to the desired position under the hanger. In one embodiment, the downhole carrier 12 is lifted and rotated to the desired orientation and then lowered or moved toward engagement with the alignment coupling 14. The weight of the downhole carrier 12 or the alignment coupling 14 lodges the downhole carrier 12 and the alignment coupling 14 together using the tapered members 16, 18. In addition to or in place of the weight, the locking mechanism may also act to lodge or secure the downhole carrier 12 and the alignment coupling 14 in place. In one embodiment, various mechanisms such as threaded holes in the downhole carrier 12 and/or bolts and threaded studs are used to assist with lifting and rotating the downhole carrier 12.

In the third step 53, the downhole carrier 12 is secured in placed by the securing mechanism 26. In one embodiment, a number or nuts and bolts, or another securing mechanism, is actuated to secure the securing mechanism 26 on the pup joint 20 or other elongated member. The securing mechanism 26 may be a part of the downhole carrier 12 or be a separate component. In one embodiment, the securing mechanism 26 is a separate component and the downhole carrier 12 is held in place by both the alignment coupling 14 and the securing mechanism.

Although the method described herein is used with the downhole carrier 12 and the alignment coupling 14, the method is not limited thereto. The method may be used in conjunction with an components that include the alignment and/or securing mechanisms described herein.

The systems and methods described herein provide various advantages over existing processing methods and devices, in that the apparatuses and methods provide downhole carriers that are easily alignable. There is no need for additional securing mechanisms such as slotted or fixed screws to secure the alignment coupling to the downhole carrier. In addition, the configuration described herein eliminated the need for "timing" threads, which is generally used to align prior art components. In addition, the configuration acts to prevent the assembly from moving if a securing mechanism such as a clamp slips. Furthermore, in some configurations, the downhole carrier need not hold any pressure, since the securing mechanism is fixed to the production string or other member and is capable of holding pressure from uphole components. Thus, the downhole carrier can be made from a wide variety of materials, potentially providing cost savings.

In connection with the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. An apparatus for aligning a component, comprising:

a downhole sub including a plurality of first axially extending tapered members, the plurality of first axially extending tapered members configured to engage a plurality of second axially extending members of a downhole carrier in an interlocking engagement and prevent rotation of the downhole carrier relative to the downhole sub;

an elongated member configured to support the downhole sub and the downhole carrier; and a securing mechanism configured to engage the downhole carrier and the elongated member in a fixed relationship, the securing mechanism including an alignment mechanism configured to rotationally align the downhole carrier to the securing mechanism.

2. The apparatus of claim 1, further comprising the downhole carrier.

3. The apparatus of claim 2, wherein the interlocking engagement is a slip fit engagement.

4. The apparatus of claim 2, wherein the downhole sub is disposed at a downhole location relative to the downhole carrier.

5. The apparatus of claim 2, wherein the downhole sub includes at least one first connection mechanism, and the downhole carrier includes at least one second connection mechanism.

6. The apparatus of claim 5, wherein the at least one first connection mechanism and the at least one second connection mechanism are selected from at least one of the group consisting of electrical, optical and hydraulic lines.

7. The apparatus of claim 1, wherein the downhole sub is configured to be secured onto the elongated member.

8. The apparatus of claim 1, wherein the elongated member is a pup joint.

9. The apparatus of claim 1, wherein the elongated member is at least a portion of a borehole string.

10. The apparatus of claim 1, wherein the securing mechanism is configured to fixedly engage the elongated member to prevent axial movement of the downhole carrier.

11. The apparatus of claim 1, wherein the securing mechanism is a component separate from the downhole carrier.

12. The apparatus of claim 1, wherein the alignment mechanism is configured to prevent rotation of the downhole carrier relative to the securing mechanism.

13. The apparatus of claim 1, further comprising one of the first and second pluralities of tapered members including at least one deformable member configured to engage at least one of another of the first and second pluralities of tapered members in an interference fit.

14. A method of aligning a component, the method comprising:

connecting a downhole sub to an elongated member configured to be lowered into a borehole, the downhole sub including a plurality of first axially extending tapered members;

moving a downhole carrier axially to engage the downhole sub, the downhole carrier including a plurality of second axially extending tapered members configured to engage the plurality of first axially extending tapered members in an interlocking engagement;

engaging the downhole carrier and the elongated member in a fixed relationship by a securing mechanism, the securing mechanism including an alignment mechanism configured to rotationally align the downhole carrier to the securing mechanism.

15. The method of claim 14, further comprising rotating the downhole carrier relative to the downhole sub prior to engaging the downhole sub.

16. The method of claim 15, wherein the downhole sub includes at least one first connection mechanism, the downhole carrier includes at least one second connection mechanism and rotating includes rotating the downhole carrier so that the at least one first connection mechanism and the at least one second connection mechanism are in alignment.

17. The method of claim 14, wherein the downhole sub is disposed at a downhole location relative to the downhole carrier.

18. The method of claim 14, wherein the interlocking engagement is a slip fit engagement.

19. The method of claim 14, further comprising securing the downhole sub onto the elongated member.

20. The method of claim 14, wherein the securing mechanism includes a clamping mechanism, and engaging includes fixedly engaging the clamping mechanism to the elongated member to prevent at least one of rotational movement and axial movement of the downhole carrier.

* * * * *